US008051868B2

(12) United States Patent
Whitlow

(10) Patent No.: US 8,051,868 B2
(45) Date of Patent: Nov. 8, 2011

(54) TENT RAFTER END CAP AND TENT INCORPORATING SAME

(75) Inventor: Anthony Whitlow, Hull, GA (US)

(73) Assignee: Johnson Outdoors Inc., Racine, WI (US)

( * ) Notice: Subject to any disclaimer, the term of this patent is extended or adjusted under 35 U.S.C. 154(b) by 130 days.

(21) Appl. No.: 12/405,337

(22) Filed: Mar. 17, 2009

(65) Prior Publication Data

US 2009/0229646 A1 Sep. 17, 2009

Related U.S. Application Data

(60) Provisional application No. 61/037,155, filed on Mar. 17, 2008.

(51) Int. Cl.
*E04H 15/32* (2006.01)

(52) U.S. Cl. ..... 135/123; 135/120.3; 135/907; 135/909; 52/63; 52/222

(58) Field of Classification Search ..... 135/119, 135/121, 122, 123, 120.3, 907, 909; 52/63, 52/222

See application file for complete search history.

(56) References Cited

U.S. PATENT DOCUMENTS

| | | | | |
|---|---|---|---|---|
| 3,143,165 | A * | 8/1964 | Lewis et al. | 160/394 |
| 3,222,841 | A * | 12/1965 | Lipof | 52/482 |
| 3,300,941 | A * | 1/1967 | Heirich | 135/121 |
| 5,224,306 | A * | 7/1993 | Cramer | 52/63 |
| 5,242,004 | A * | 9/1993 | Stilling | 160/57 |
| 5,784,842 | A * | 7/1998 | Wackerbauer | 52/222 |
| 6,338,226 | B1 * | 1/2002 | Gauthier et al. | 52/63 |
| 6,345,638 | B1 * | 2/2002 | Warner | 135/123 |
| 6,408,587 | B2 * | 6/2002 | Cronin et al. | 52/637 |
| 6,814,094 | B1 * | 11/2004 | Barber | 135/119 |
| 7,389,785 | B2 * | 6/2008 | Loudermilk et al. | 135/121 |
| 2006/0201104 | A1 * | 9/2006 | Hallett et al. | 52/750 |
| 2007/0240746 | A1 * | 10/2007 | Chen | 135/119 |
| 2009/0230257 | A1 * | 9/2009 | Reyen et al. | 248/74.2 |
| 2010/0212710 | A1 * | 8/2010 | Roder | 135/121 |

* cited by examiner

*Primary Examiner* — Noah Chandler Hawk
(74) *Attorney, Agent, or Firm* — Reinhart Boerner Van Deuren P.C.

(57) ABSTRACT

A tent including a structural member and an end cap insertable into the structural member and a method of forming a tent are provided. The structural member is preferably a rafter. The rafter has C-channels aligned with support troughs of the end cap. The C-channels and support troughs receive edge portions of a fabric panel therein to secure the fabric panel to the rafter. The end cap supports the weight of the fabric panel during assembly to reduce or avoid engagement of the fabric panel with corners of the C-channel or burs formed in the end of the C-channel of the rafter as the fabric panel is fed through the C-channel. The end cap may also include an optional tension push down bar assembly for providing additional tensioning of the fabric panel.

11 Claims, 13 Drawing Sheets

TENT RAFTER END CAP AND TENT INCORPORATING SAME

CROSS-REFERENCE TO RELATED PATENT APPLICATIONS

This patent application claims the benefit of U.S. Provisional Patent Application No. 61/037,155, filed Mar. 17, 2008, the entire teachings and disclosure of which are incorporated herein by reference thereto.

FIELD OF THE INVENTION

This invention generally relates to tents and more particularly to tent frames and structural members of tent frames.

BACKGROUND OF THE INVENTION

A tent can be very large and can be used for providing a shelter and environment for large gatherings and celebrations such as, for example, concerts, theatrical events, wedding receptions and conventions. The tent generally includes a shell, formed from one or more fabric panels, that is supported by a frame made of numerous structural members. The structural members may include vertical legs that define the walls and rafters that extend at an angle relative to the vertical legs and toward a peak of the tent to define the roof.

Many of the structural members are formed from extruded aluminum box beams to reduce weight while structural strength is retained. Some extrusions include C-channels formed at the corners of the box beams. The C-channels receive enlarged edges of individual fabric panels that combine to form the shell of the tent.

However, when the structural members are cut to length, the ends of the structural members, and particularly the C-channels can become burred. Additionally, the rafters can be dropped or banged during assembly or transportation such that the corners of the C-channels at the ends of the structural members provide a sharp or bent edge. If the C-channels are burred or the corners bent, the fabric panels can be caught on the burs and corners and then tear as the fabric panels are fed along the length of the rafters.

To prevent tearing of the fabric panels, the ends of the rafters are typically manually deburred or unbent after the rafters are cut to length. However, this process can be very time consuming. Further, even if the ends have been deburred, the corners can still be damaged as described above, and the user may not realize that a corner of the C-channel has become sufficiently bent or damaged to snag the fabric panels during assembly.

The present invention provides improvements to structural members for forming tents to prevent the fabric panels from being caught on burs or bent corners of the rafters. Embodiments of the present invention also provide more cost effective methods of avoiding necessary time consuming secondary deburring.

BRIEF SUMMARY OF THE INVENTION

The present invention has several aspects that may be claimed and stand as patentable independently and individually or in combination with other aspects, including but not limited to the following.

A first embodiment of the invention relates to an end cap for a structural member to assist in guiding a fabric panel of the tent into engagement with a channel in the structural member. In this embodiment, the end cap inserts into a hollow end of the structural member. The end cap includes a main body defining an outer face and an inner face. The end cap further includes a mounting flange extending outward from the inner face. The mounting flange defines four sides. The end cap further includes at least two C-channels formed in the main body proximate corners of the main body. These C-channels of the end cap align with C-channels of the structural member.

In another embodiment, the present invention provides a tent incorporating a frame including at least one structural member, an end cap positioned adjacent the end of the structural member and a fabric panel attached to the structural member. The at least one structural member has a pair of first C-channels extending along a length of the structural member. The end cap has a main body having an outer face and an inner face, opposite the outer face. The inner face facing the structural member. The main body includes a pair of support troughs. One of the support troughs aligns with a corresponding one of the first C-channels. The other one of the support troughs aligns with a corresponding other one of the first C-channels. The fabric panel includes an enlarged edge portion received in one of the first C-channels of the rafter and the corresponding support trough of the end cap. The support trough's provide vertical support for the enlarged edge portion of the fabric panel during assembly of the tent.

In one particular implementation, the first C-channels do not have an identical profile as the support troughs. However, bottom surfaces of the C-channels and support troughs generally align. However in alternative embodiments, the bottom surfaces may not align. In one embodiment, the bottom surface of the support trough is vertically above the bottom surface of the C-channel to lift the enlarged edge portion of the fabric panel up from the bottom surface of the C-channel to more fully remove weight support of the fabric panel during assembly of the tent. In an even more preferred implementation, the first C-channels have a narrowed mouth and define undercuts and the support troughs are U-channels that have a mouth that forms the widest portion of the U-channels such that it is free of undercuts.

An end cap according to embodiments of the invention may or may not be directly mounted to the structural member. In one embodiment, the end cap is mounted to a connector between the structural member and another structural member, such as a leg-to-rafter connector that connects a leg structural member to a rafter structural member.

In further embodiments, an end cap may have a tensioning device mounted thereto. The tension device is connected to an end portion of the fabric panel and can be used to adjust axial tension of the fabric panel. The tensioning device includes an internally threaded mount and a cooperating externally threaded adjustment rod, the adjustment rod moveable relative to the front face via rotational motion relative to the threaded mount so as to adjust tension on the fabric panel. Further yet, the tensioning device may further include at least one fabric panel attachment bar extending outward from the adjustment rod and the end portion of the fabric panel defines a pocket extending generally perpendicularly to the edge portion, the attachment bar extends into the pocket to connect the tension device to the fabric panel. The tensioning device may operate on a portion of the fabric panel that drapes downward from the end of the rafter of the tent that extends generally parallel to a vertical side of the tent defined by the legs of the tent.

A method of assembling a tent is also provided in one implementation of the invention. The method includes the following steps: 1) positioning an end cap adjacent an end of a tent rafter having a fabric mounting channel; 2) feeding an edge portion of the fabric panel through the fabric mounting channel, starting the feeding at the end of the tent rafter; 3) supporting at least a portion of the weight of the portion of the fabric panel that is not fed through the fabric mounting channel or resting on the ground by the end cap. This method removes the weight of the suspended, i.e. vertically draping, portion of the fabric panel from the structural member, i.e. rafter, during assembly. As such, damage to the fabric panel due to blemishes in the structural member can be reduced or avoided. Thus, in one implementation, the method includes the step of providing the majority of the non-vertical lateral support for the fabric panel by the tent rafter and not the end cap.

In a more particular implementation, the step of positioning an end cap adjacent an end of the tent rafter includes aligning a fabric supporting trough of the end cap with the fabric mounting channel of the of the tent rafter.

Further, to provide a uniform and desired tension to the fabric panel, the method may further include the step of tensioning the fabric panel by engaging a free end portion of the fabric panel that extends substantially perpendicular to the edge portion of the fabric panel with a tension device. The step of tensioning the fabric panel may include extending the tensioning device vertically downward to increase tension in the fabric panel. The step of engaging the free end portion of the fabric panel may include inserting a lateral attachment bar into a pocket formed by the free end portion. The lateral attachment bar preferably extends into the pocket in a direction being substantially perpendicular to the edge portion of the fabric panel.

In yet another embodiment of the invention, an end cap for being positioned proximate an end of a structural member of a tent for supporting a fabric panel of a tent during assembly of the tent is provided. The end cap includes a main body having a substantially rectangular periphery and an outer face and an inner face, opposite the outer face. The main body includes a pair of support troughs proximate adjacent corners of the main body extending between the outer face and the inner face. The support troughs are bounded at least in part by two wall portions defining a mouth therebetween. The wall portions extending from a bottom portion of the support trough. The bottom portion facing vertically upward.

Other embodiments of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
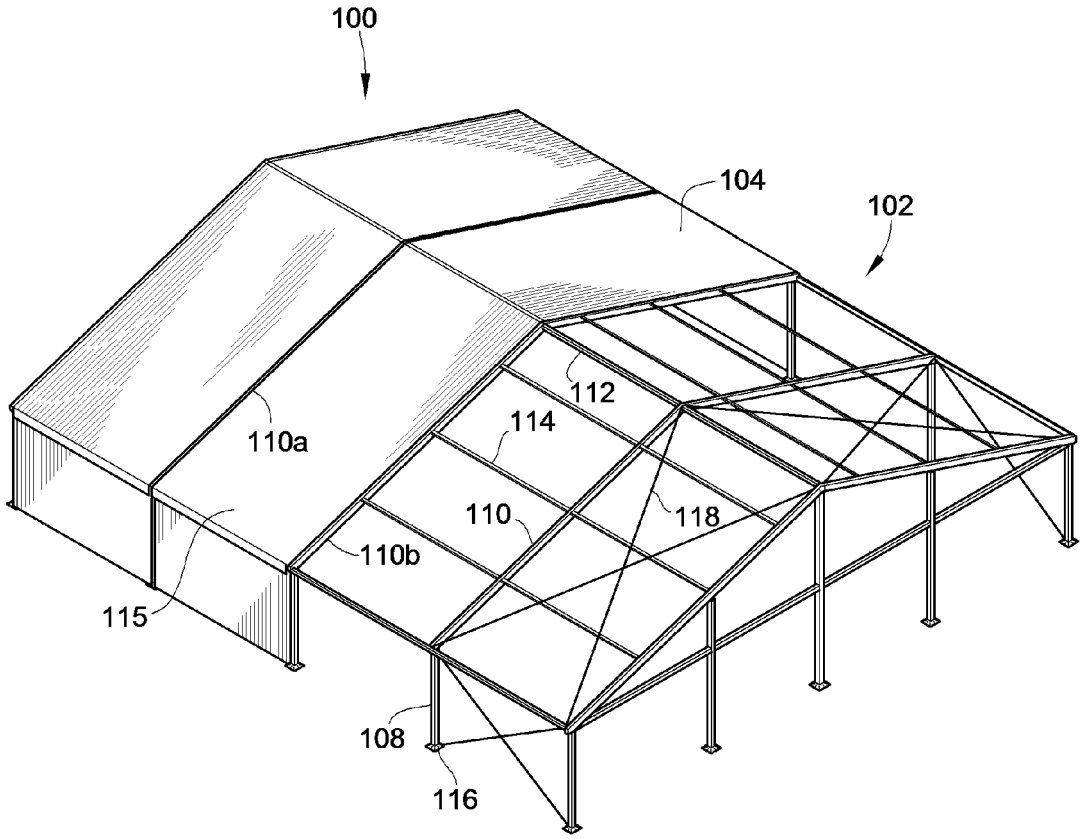
FIG. 1 is a partial perspective illustration of a tent according to the teachings of the present invention.

FIG. 1 illustrates a partial illustration of a typical tent 100 including structural members in accordance with the teachings of the present invention. The tent 100 includes a tent frame 102 that supports a shell 104 to provide a shelter or building like structure.

The tent frame 102 is generally constructed of a plurality of structural members including a plurality of legs 108 that generally define the vertical walls of the tent, a plurality of rafters 110 that extend at an angle relative to the legs 108 and that meet at the peak 112 of the tent 100 and a plurality of purlins 114 that extend horizontally between the rafters 110 and generally parallel to the peak 112. Typically, purlins 114 are made of smaller profiles. The peak 112 is formed by purlins 114. Purlins in this position are also referred to as ridge purlins. The illustrated tent frame 102, is a clear span tent frame that is free of interior poles.

The legs 108 are mounted to feet 116 which rest on the ground upon which the tent 100 is built that support the legs 108 in an upright or vertical orientation. During installation, the feet 116 allow the legs 108 to be pivoted from a horizontal position into an upright position.

The tent 100 may further include guy-wires 118 at predetermined locations that extend between various structural members to provide increased support and stability to the structure.

Figure 2:
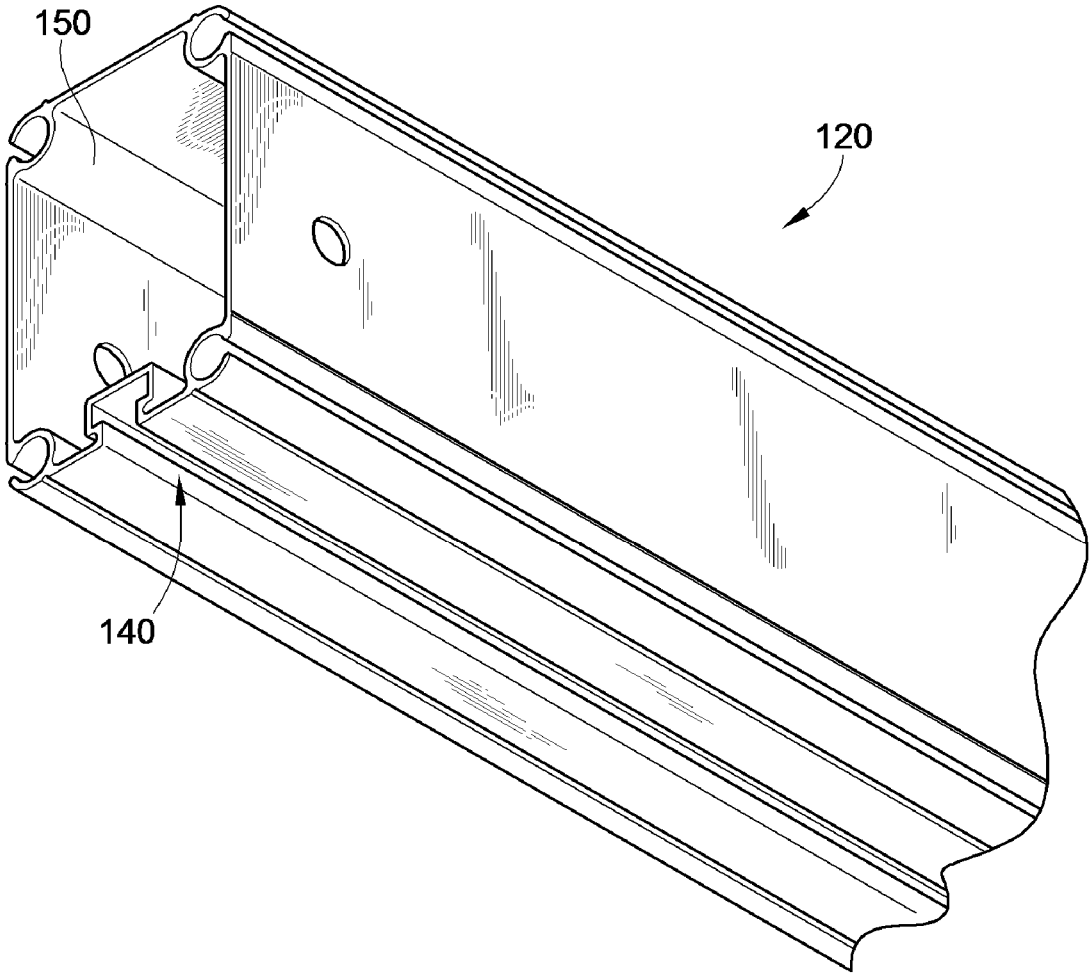
FIG. 2 is a perspective illustration of a structural member of the tent of FIG. 1.
Figure 3:
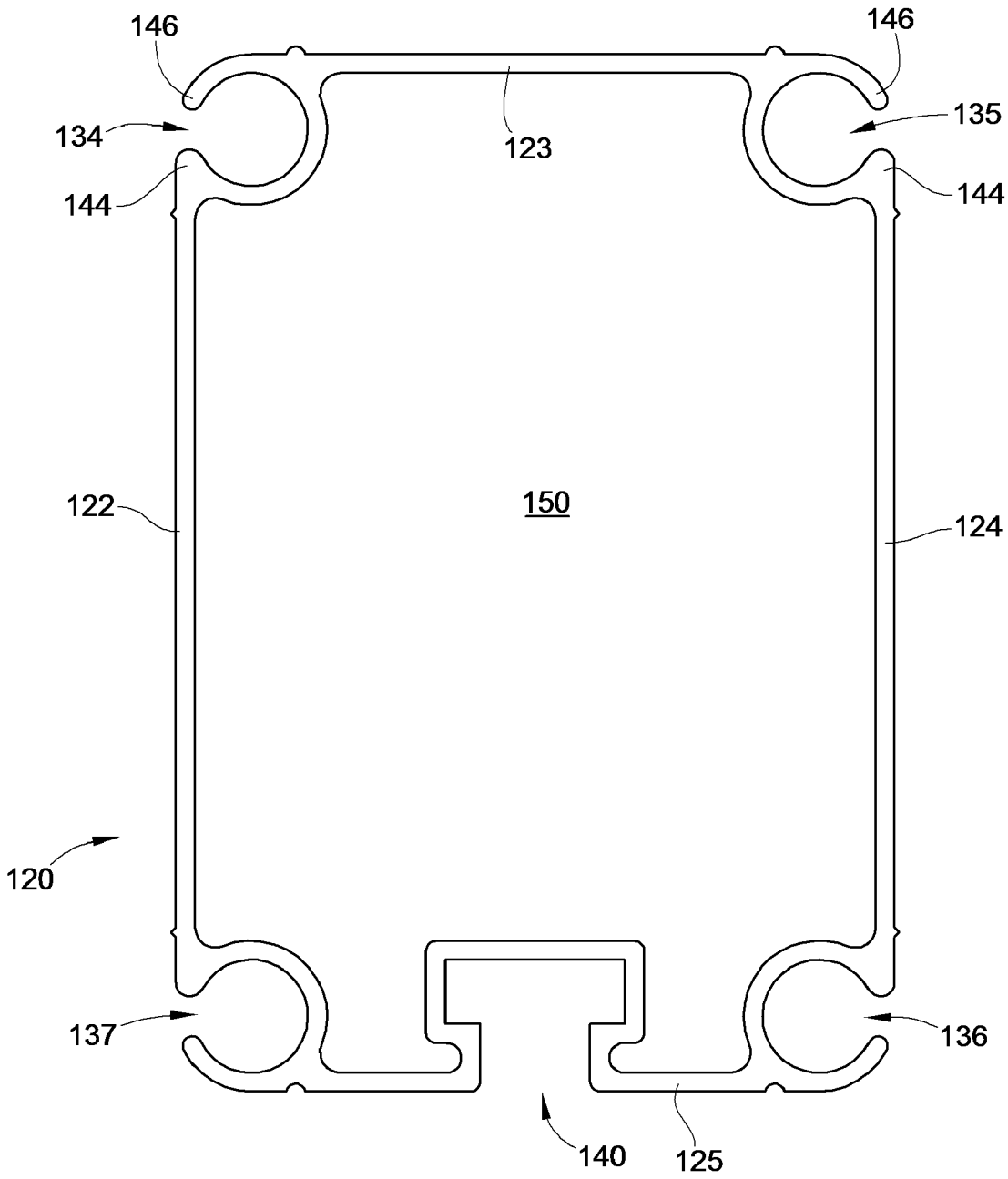
FIG. 3 is an end profile view of the structural member of FIG. 2.

FIGS. 2 and 3 illustrate a structural member 120 that can be used as any of the components of the tent frame 102, such as a leg 108, rafter 110 or purlin 114 of the tent frame 102. With primary reference to FIG. 3, the structural member 120 is of a hollow box beam construction having a generally rectangular cross-section including sides 122-125. Typically, but not always, the structural member 120 is formed from extruded metal, and more typically from extruded aluminum.

The corners formed by the intersections of adjacent ones of the sides 122-125 include C-channels 134-137 that extend the length of the structural member 120. As used here in "C" refers to a shape or arrangement that has a mouth that leads to an enlarged cavity. The mouth is narrowed relative to the enlarged cavity and provides an undercut arrangement such that an enlarged object within the enlarge cavity cannot be pulled, without deformation, through the mouth.

Figure 4:
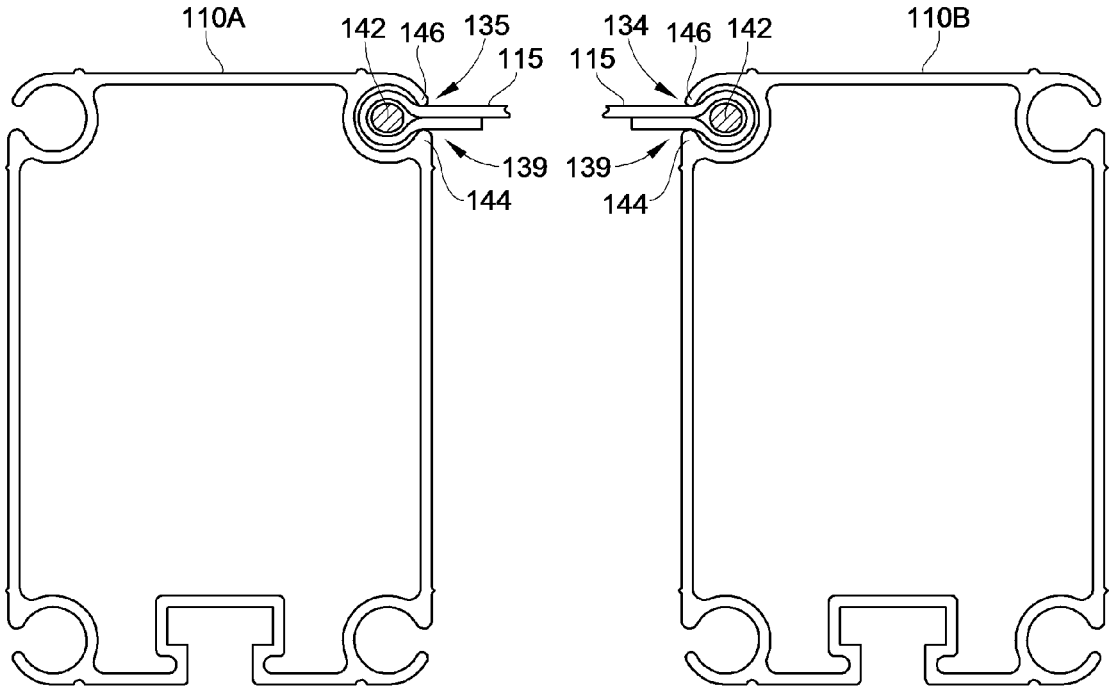
FIG. 4 is an end profile view of a pair of rafters having a partially illustrated fabric panel secured therebetween.

When the structural member 120 is used as a rafter 110, the C-channels 134-137 are used to engage an edge of a fabric panel 115 (see FIGS. 1 and 4). Each fabric panel 115 includes an enlarged seam 139 formed at the edges. Typically, the enlarged seam is formed by folding over an edge portion of the fabric panel 115 back onto itself to form a pocket which receives a piece of rope 142 to produce the enlarged or bulbous cross-section, such as illustrated in FIG. 4. This enlarged seam 139 is axially inserted into one of the C-channels 134-137 to secure the fabric panel 115 to one of the rafters 110. A particular example of such a fabric panel is the Keder "Two Flap" design produced by American Keder, Inc. of Rindge, N.H. In preferred embodiments, the width of the fabric panel 115 between the opposed enlarged seams 139 is approximately 15 feet. However, other widths for fabric panels 115 may be implemented. Further, other forms of the enlarged edges of the fabric panels 115 may be used.

To insert the enlarged seam 139 into the C-channel 134-137, the enlarge seam 139 is inserted into the C-channel 134-137 starting at the end of the rafter 110 and then it is pulled through the C-channel the length of the rafter 110. Unfortunately, as described previously, the corners 144, 146 of the C-channel 134-137 can be come bent and the end of the C-channel 134-137 can include burs where the structural member 120 is cut. These blemishes in the C-channel 134-137 can catch and tear the fabric panel 115 as the fabric panel 115 is fed through the C-channel 134-137.

This may be particularly true, if the fabric panels 115 are being inserted into the C-channels 134-137 after the tent frame 102 is assembled with the rafters 110 raised in the air, sometimes in excess of ten feet. In this situation, the fabric panels 115 will drape down over the side of the tent frame 102 such that the weight of the hanging portion of the fabric panel 115 is applied directly to the ends and corners 144, 146 of the C-channels 134-137. This localized loading increases the pressure applied to the fabric and increases the likelihood of tearing or piercing, particularly, when the corners 144, 146 are bent or burred.

Further, as noted, deburring or unbending of the ends of the rafters 110 a is time-consuming process and a process that may not completely eliminate the problem of tearing the fabric panels due to damage to the C-channels 134-137 during assembly of the tent 100 or transport of the rafters 110.

Figure 5:
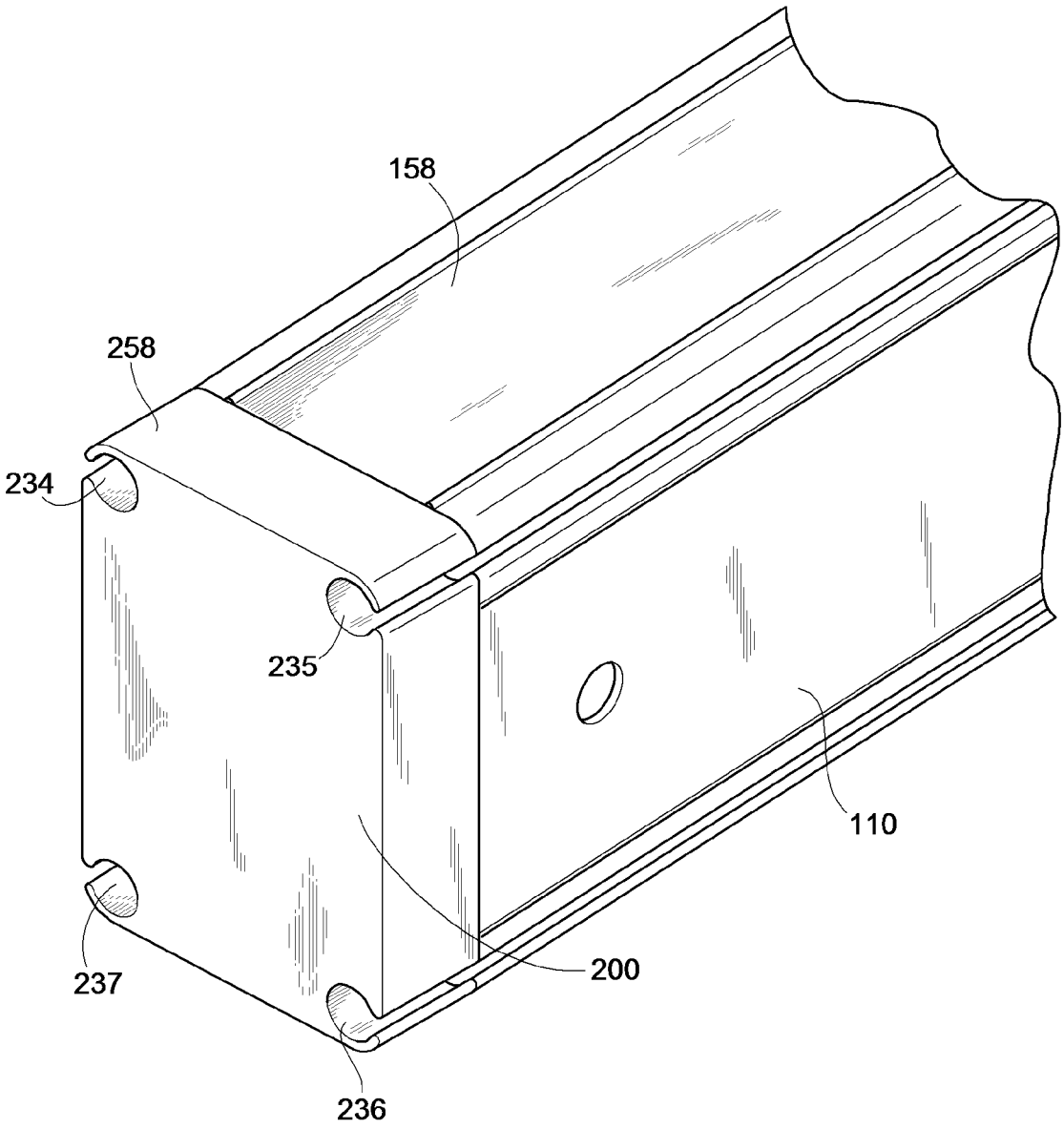
FIGS. 5 and 6 are isometric illustrations of a rafter having an end cap attached to an end of the rafter.
Figure 6:
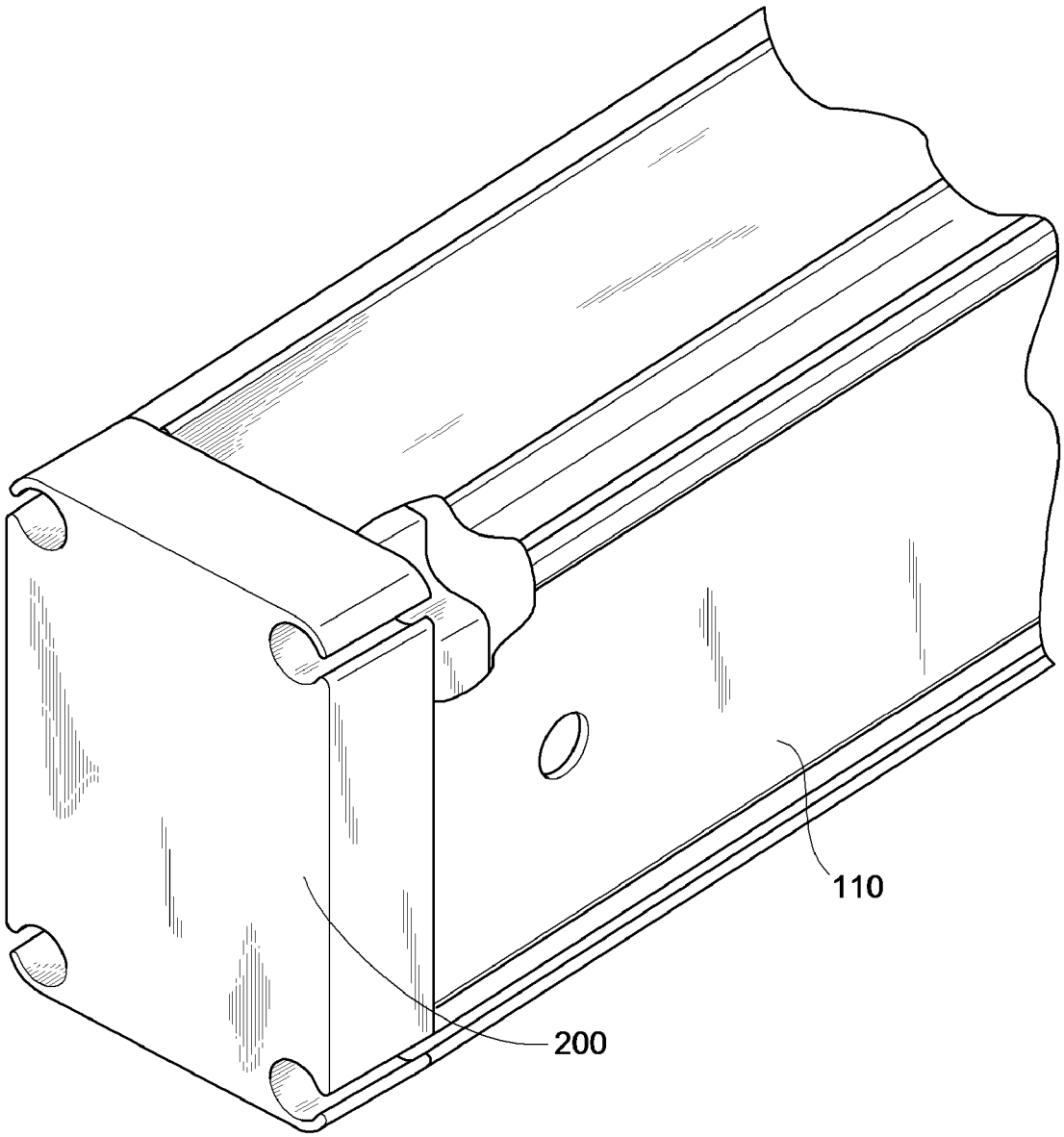

However, as illustrated in FIGS. 5 and 6 each rafter 110 of the illustrated tent 100 incorporates an end cap 200 that acts to eliminate and reduce the danger of tears resulting from burs or bent corners 144, 146 of the C-channels 134-137 of the rafters 110. The end cap 200 inserts into an end of the rafter 110 prior to connecting the fabric panels 115 to the rafter 110. Preferably, the end cap 200 is formed from a cast aluminum. However, it can also be a molded material, and particularly a molded plastic. Also, the end cap 200 could be used in any of the structural members of the tent frame 102.

In this embodiment, the shape of the end cap 200 corresponds with the shape of the end of the rafter 110. As such, the end cap 200 includes support troughs that are illustrated in the form of C-channels 234-237 formed proximate the corners of the end cap 200 that generally align with and have substantially the same profile as C-channels 134-137 of the rafters 110. However, as the end cap 200 is preferably formed of a cast aluminum, the corners and ends of the C-channels 234-237 of the end cap 200 are free of burs. As the end caps 200 may be removable from the rafters 110, the end caps 200 can avoid being damaged during transportation of the rafters 110 and assembly of the tent frame 102. As such, as the fabric panels 115, and particularly enlarged seams 139 are fed through the C-channels 234-237 of the end cap 200 the likelihood of tearing is significantly reduced.

As the end caps 200 are removable from the rafter 110, the end cap can be easily replaced in the event that it becomes damaged during assembly, disassembly or transport of the tent 100. Further, as the end caps 200 are removable, small and easy to handle, the end caps 200 are more easily repaired.

Figure 7:
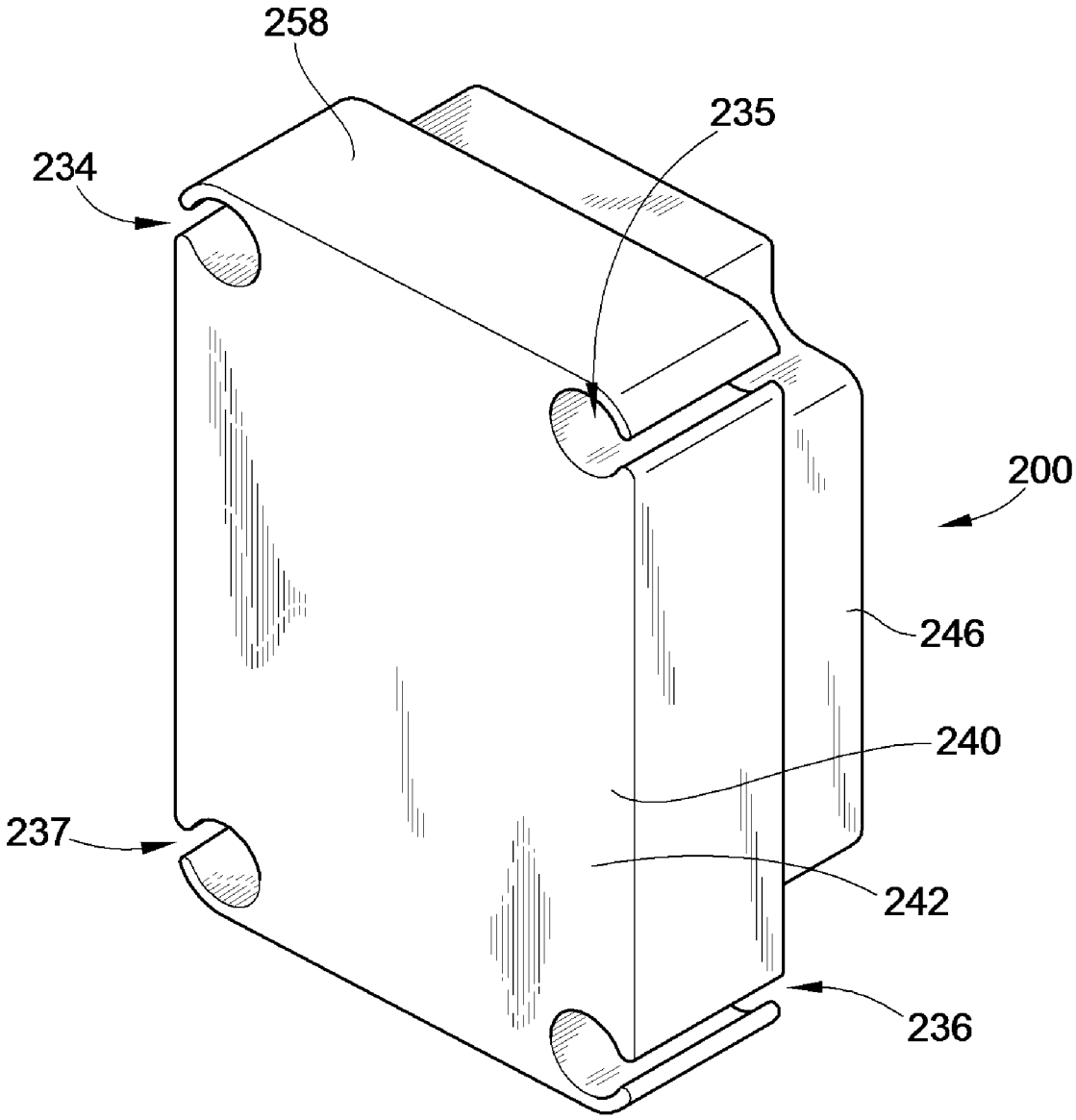
FIGS. 7-8 are isometric illustrations of the end cap of FIGS. 5 and 6 by itself.
Figure 8:
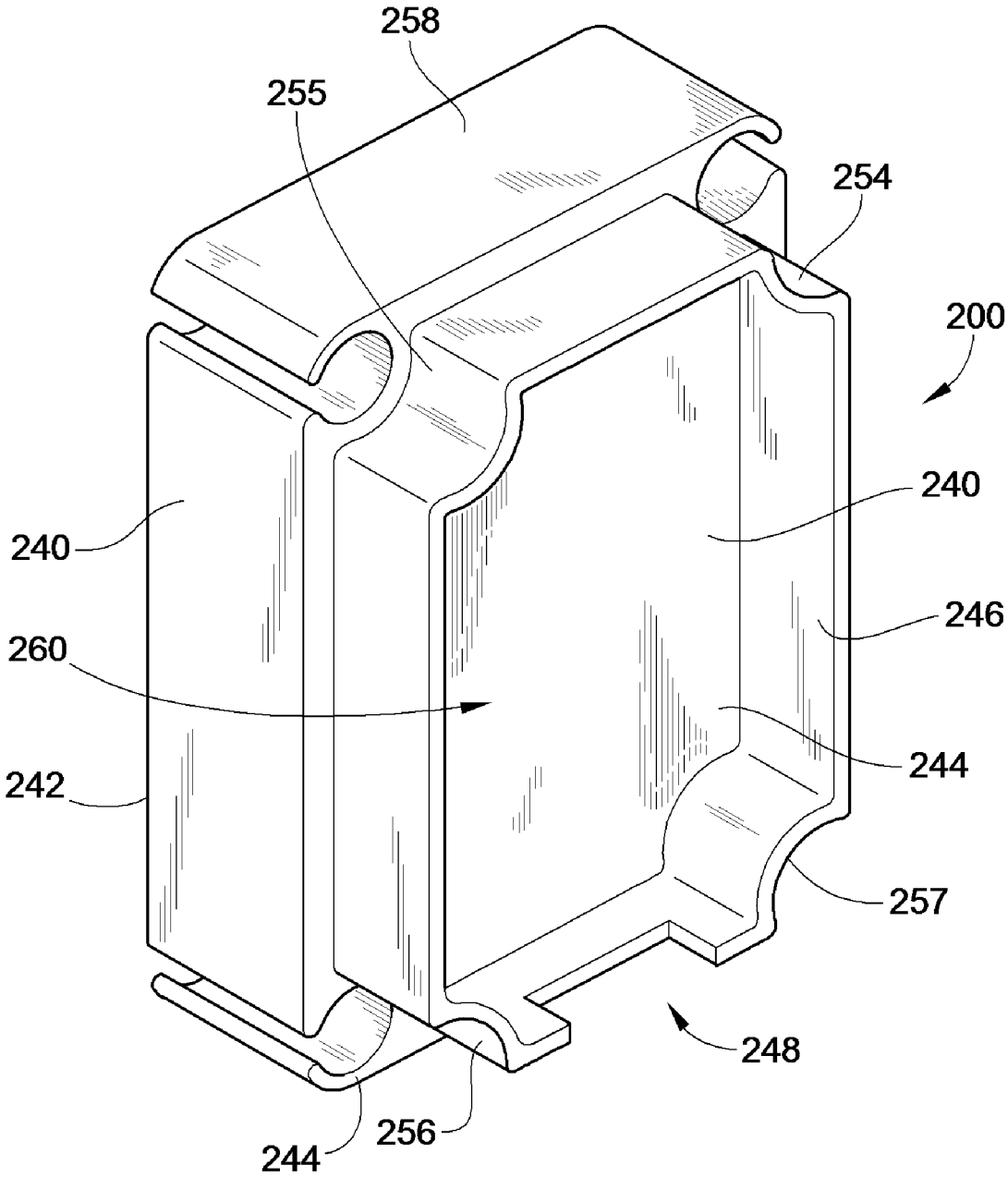

With reference to FIGS. 7, and 8, the end cap 200 includes a main body 240 having an outer face 242, which faces away from the rafter 110 when installed, and an inner face 244, opposite the outer face 242, from which a mounting flange 246 extends. The mounting flange 246 is configured to insert into the center cavity 150 of the rafter 110 and mate with the sides 122-125 of the rafter 110. As such, the mounting flange 246 is recessed laterally or radially inward from the edges of the main body 240. This arrangement forms a stepped profile that also acts as a stop to prevent the end cap 200 from being axially inserted too far into rafter 110. The stop abuts against the end of raffle 110. As such, the illustrated mounting flange 246 is generally rectangular in shape and has concave corners 254-257. In the illustrated embodiment, the mounting flange 246 and inner face 244 form a cavity 260; however, not all embodiments need to form cavity 260.

As the illustrated end cap 200 is intended for a rafter 110 that extends at an angle to form a slanted roof, the end cap 200 is similarly slanted. More particularly, the mounting flange 246 extends at an same angle as the slope of the roof or cut end of the rafter 110 relative to the outer face 242 of the end cap 200. This configuration causes the top surface 258 of the end cap 200 to align with a top surface 158 of the rafter 110 to form a substantially continuous surface at the junction thereof. The same applies to the other surfaces of the end cap 200 and rafter 110. Further, the C-channels 234-237 are similarly slanted so as to generally align with the C-channels 134-137 of the rafters 110 to again form a substantially continuous surface at the junction thereof. The degree of slant corresponds to the degree of slope of the roof of the tent 100 defined by the rafters 110. However, some slight deviation between end cap 200 and the profile of rafter 110 may occur.

Figure 10:
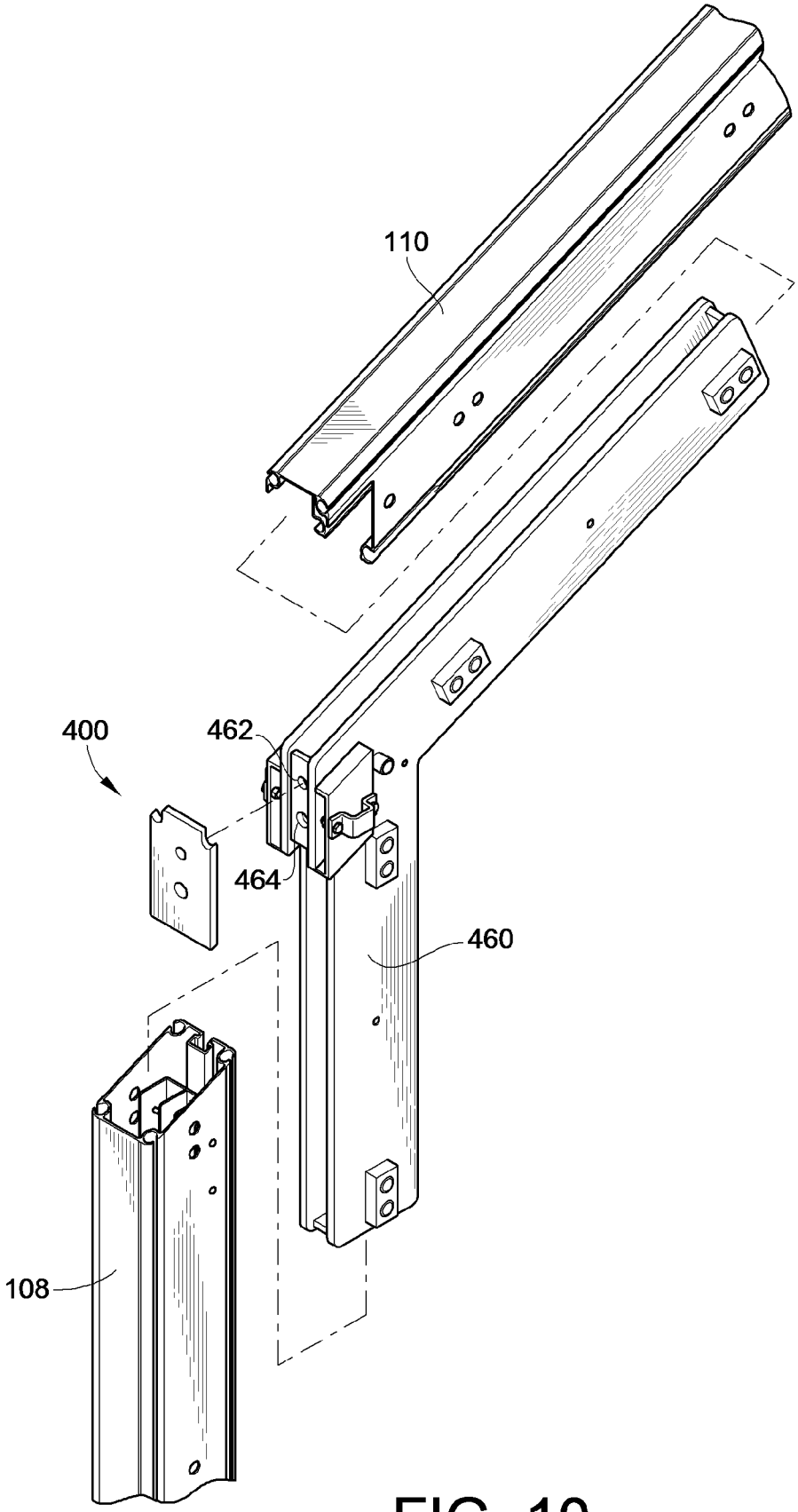
FIG. 10 is an exploded illustration of a leg, rafter, roof-to-leg connector and an end cap according to an embodiment of the present invention.

In the illustrated embodiment, the mounting flange 246 is continuous. However, in alternative embodiments it can be formed by flange segments. Further, the end cap 200 need not include support troughs in all of the corners, such as illustrated by end cap 400, described more fully below with reference to FIG. 10.

The illustrated mounting flange 246 includes a gap 248 formed in a bottom side to accommodate the irregularly shaped side 125 defining utility channel 140.

In some embodiments, the size of the C-channels 234-237 of the end cap 200 are the same size as the C-channels 134-137 of the corresponding rafter 110. Alternatively, the C-channels 234-237 might be slightly smaller to further prevent any unintended interaction of any burs or bent corners that may exist on the rafter 110 from contacting the fabric panel 115 during assembly.

In a preferred embodiment, the main body 240 and mounting flange 246 are formed as one piece. As used herein "one-piece" shall refer to a continuous piece and shall not include multiple components fixed together.

Figure 9:
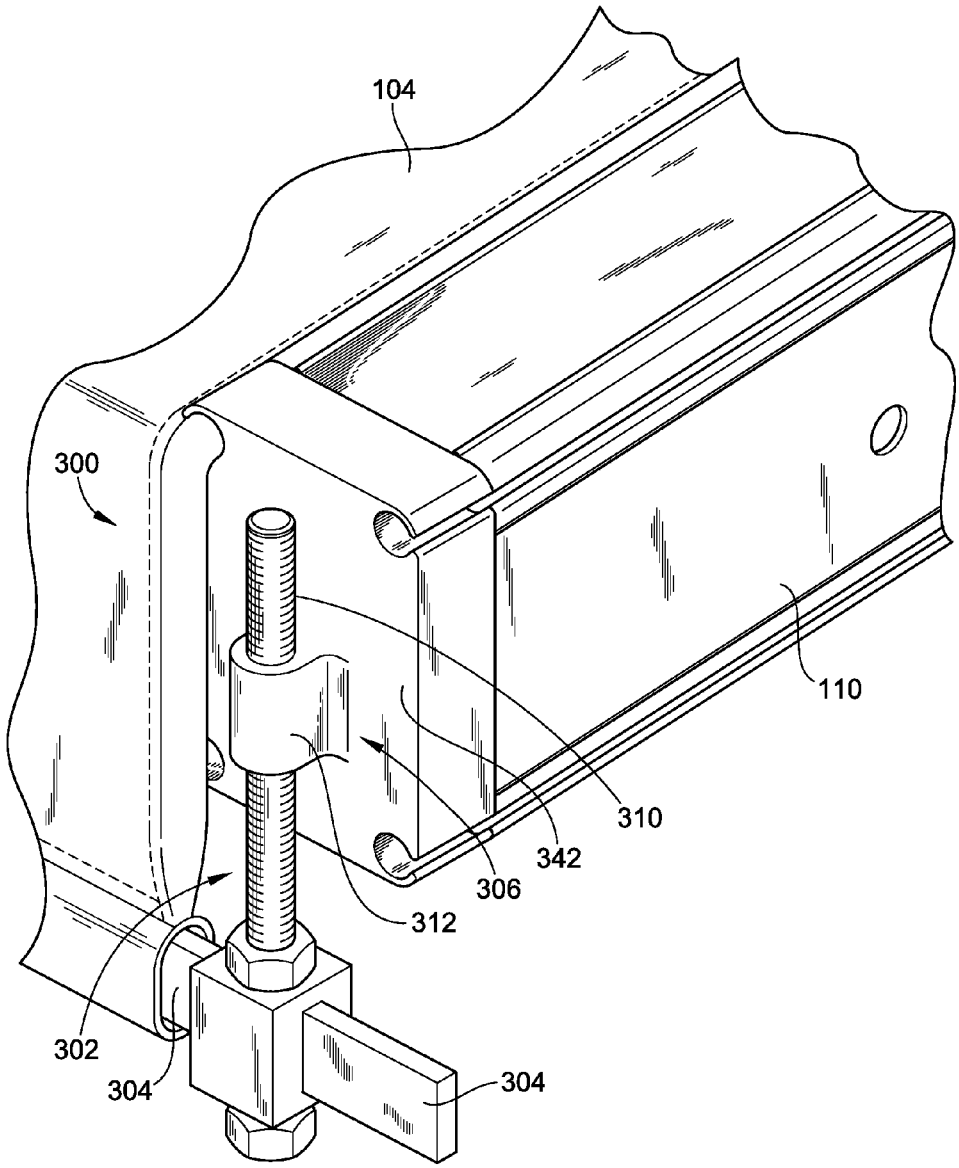
FIG. 9 is an isometric illustration of a second embodiment of an end cap incorporating a tension push down bar assembly.

A further embodiment of an end cap 300 is illustrated in FIG. 9. This end cap 300 includes a tension push-down bar assembly 302 mounted to the outer face 342 of the end cap 300. The tension push down bar assembly 302 is used to tension the fabric panels 115 after being mounted to the rafters 110.

The tension push down bar assembly 302 includes lateral attachment bars 304 to which the end of a fabric panel 115 is secured. The tension push down bar assembly 302 further includes an adjustment arrangement 306 for selectively stretching and tensioning the fabric panel 115. The tension push down bar assembly 302 is configured to adjust and/or maintain the position of the lateral attachment bars 304 relative to the rafters 110 to adjust and/or maintain the tension of the fabric panel 115.

In one embodiment, the adjustment arrangement 306 includes an adjustment shaft 310 that is externally threaded and a mount 312 connected to outer face 342 that is internally threaded. As such, rotation of adjustment shaft 310 causes the shaft 310 to move axially relative to mount 312 to adjust the relative position of the lateral attachment bars 304 and consequently the tension of the fabric panels 115 attached thereto. In the illustrated embodiment, the shaft 310 moves generally parallel to the outer face 342 of the end cap 300, which is ultimately parallel to the legs 108 and walls of the tent 100. Further securement mechanisms, rather than threads, could be used, such as pins, set screws, or latch mechanisms.

Alternatively, shaft 310 may be fixed relative to the rafter 110 and to the attachment bars 304 move axially relative thereto.

The lateral attachment bars 304 may be configured to be releasably connected to shaft 310 such that the attachment bars 304 can extend through a pocket formed in an end of the fabric panel 115 and running between the edges of the fabric panel 115. In such an embodiment, each end of an attachment bar 304 would be connected to an adjustment shaft 310 proximate the rafters 110 on each edge of the fabric panel 115.

In a further alternative embodiment, a tension bar (not shown) may connect to the attachment bars and extend through the pocket the entire length of the pocket. As such, when the attachment bars 304 are pushed down, the connected tension bar inset in the pocket will also fully tension the fabric panel 115.

However, as illustrated, the attachment bar 304 is a stub or post that can extend a limited distance into a pocket formed in the end of the fabric panel, such as a similar pocket as that which forms the enlarged seam 139. However, alternative connections between the fabric panel 115 and the attachment bar 304 are contemplated such as snaps, clips, rope, etc.

Further, some embodiments of end caps including a tension pull down bar assembly 302 may not include the support troughs.

FIGS. 10-14 illustrate a further end cap 400 according an embodiment of the present invention. The end cap 400 is similar to previous embodiments in that it acts to eliminate the danger of tears resulting from burs or bent corners 144, 146 of the C-channels 134-137 of the rafters 110. Like the previous embodiments, the end cap 400 is positioned adjacent and end of the rafters 110. However, in this embodiment, the end cap 400 is not directly attached to the rafter 110. Preferably, the end cap 400 is formed from a cast or machined aluminum. However, it can also be plastic, such as molded plastic.

Because the end cap 400 is not formed as part of the rafter 110, the end cap 400 can be easily replaced in the event that it becomes damaged during assembly, disassembly or transport of the tent 100. Further, as the end caps 400 are removable, small and easy to handle, the end caps 400 are more easily repaired.

Because the end caps 400 may be removable from the rafters 110, the end caps 400 can avoid being damaged during transportation of the rafters 110 and assembly of the tent frame 102. As such, as the fabric panels 115, and particularly enlarged seams 139 are fed through the support troughs 434, 435 of the end cap 400 the likelihood of tearing is significantly reduced.

The end cap 400 is formed from a main body 440 or plate having an outer face 442, which faces away from the rafter 110 when installed, and an inner face 444, opposite the outer face 442. A pair of mounting holes 446, 448 pass through the main body 440 from the outer face 442 to the inner face 444 for mounting the end cap 400 as this end cap design does not include the mounting flange of the prior designs.

As the illustrated end cap 400 is intended for a rafter 110 that extends at an angle to form a slanted roof, the end cap 400 is similarly slanted. More particularly, a top surface 450 extending between the outer and inner surfaces 442, 444 extends at a same angle as the slope of the roof or cut end of the rafter 110 relative to the outer face 442 of the end cap 400. This configuration causes the top surface 450 of the end cap 400 to align with a top surface 158 of the rafter 110 to form a substantially continuous surface at the junction thereof, in embodiments where the end cap is substantially abutted against an end of rafter 110. The same applies to the other surfaces of the end cap 400 extending between the outer and inner surfaces 442, 444. Further, the C-channels 434, 435 are similarly slanted so as to generally align with the C-channels 134, 135 of the rafters 110 to again form a substantially continuous surface at the junction thereof. The degree of slant corresponds to the degree of slope of the roof of the tent 100 defined by the rafters 110. However, some slight deviation between end cap 400 and the profile of rafter 110 may occur.

Because the illustrated end cap 400 is only intended to help support the fabric panel 115 during assembly of the tent rather than provide lateral support or engagement, the support troughs 434, 435 do not form vertical undercuts. As such, the end cap 400 includes its own support troughs 434, 435 formed proximate the corners of the end cap 400 that generally align with the C-channels 134, 135 of the rafters 110. FIGS. 10-14 illustrate that these support troughs 434, 435 are not C-channels in this embodiment, but are U-channels. As used herein, a "U" has a bottom and two upstanding legs, the legs do not extend over the bottom such that undercuts are formed. As such, a "U" is different than a "C" as used herein. The support troughs 434, 435 are bounded on one side by a short stub wall 470, 472 on one side and a vertical wall 474, 476 on the other side, with the troughs facing outward away from the bottom 478 of the end cap 400. In this arrangement, the mouths 480, 482 form the widest portion of the of the support troughs 434, 435, unlike the prior embodiments where the mouths were reduced in width relative to the rest of the channels.

The end cap 400 is illustrated as being configured to mount to a rafter-to-leg connector 460 (RTL 460) rather than directly to the rafter 110 itself. Thus, the RTL 460 includes corresponding mounting apertures for receiving bolts that would pass therethrough as well as apertures 446, 448 passing through the end cap 400. However other means of mounting the end cap 400 to the RTL 460 could be incorporated. For example, spring clips could be used such that the end cap 400 merely clips to the RTL 460.

Figure 11:
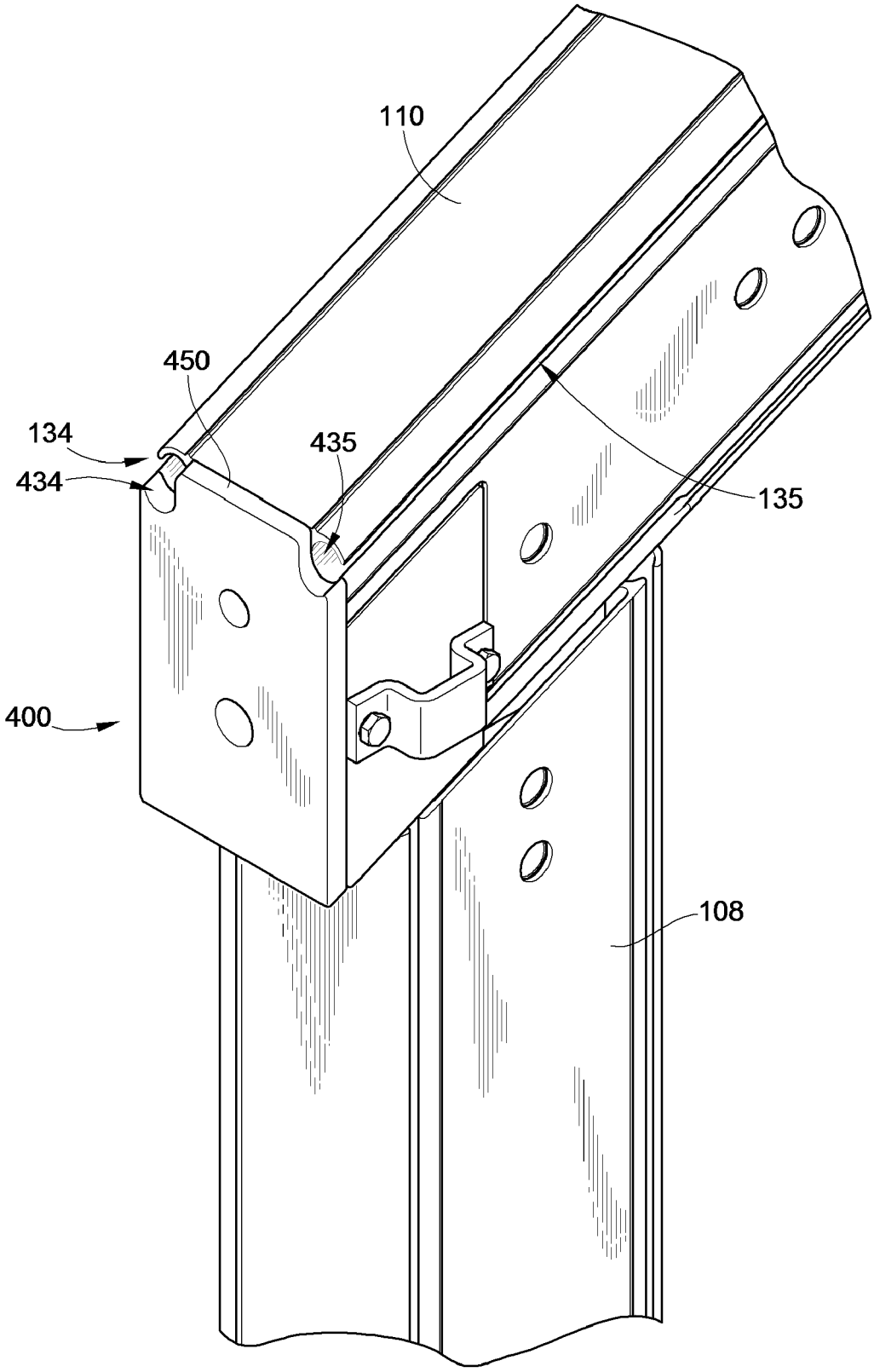
FIG. 11 is a top perspective illustration of FIG. 11 in an assembled arrangement.
Figure 12:
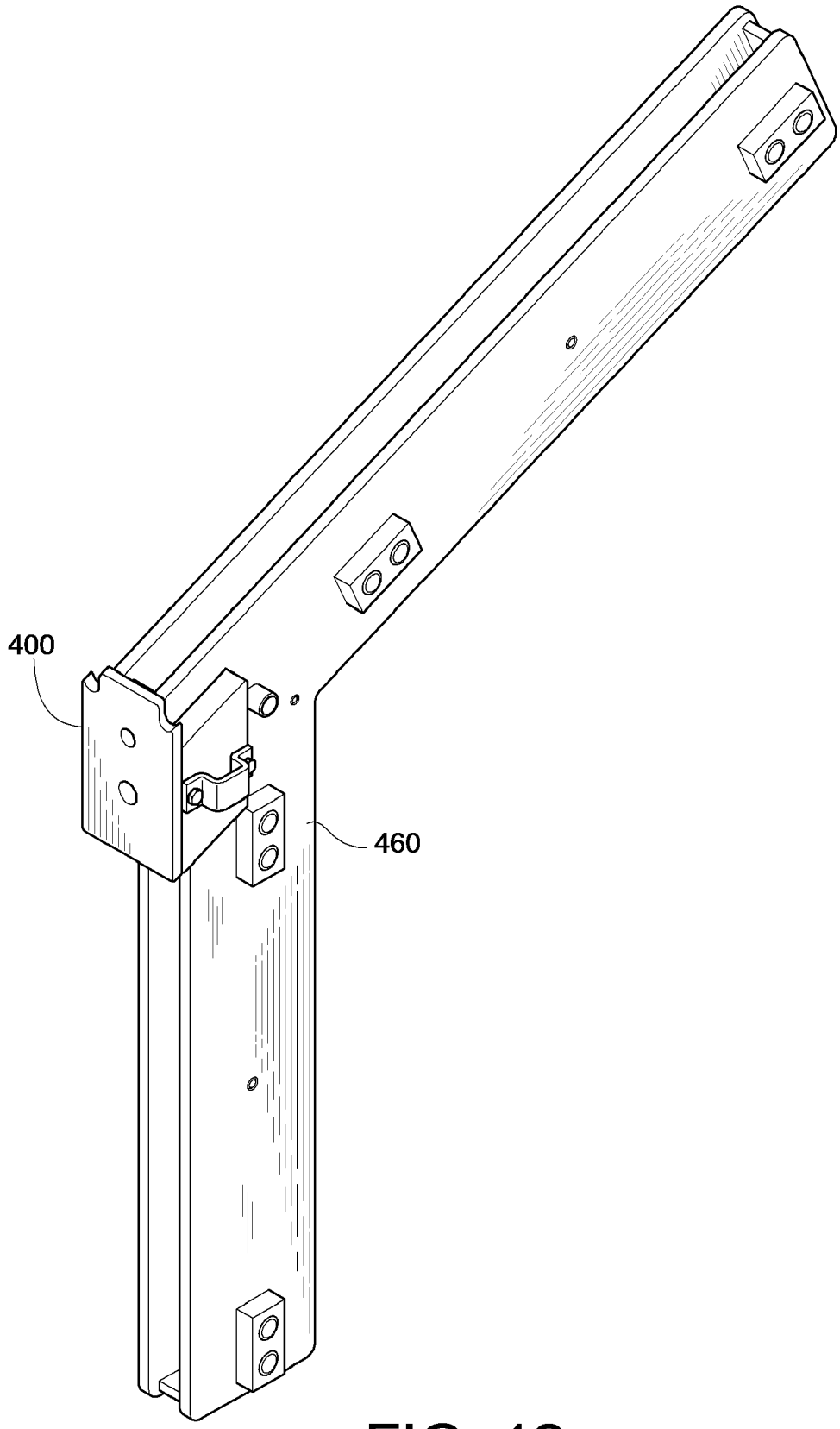
FIG. 12 is a top perspective illustration of the end cap and leg-to-roof connector of FIG. 10.
Figure 13:
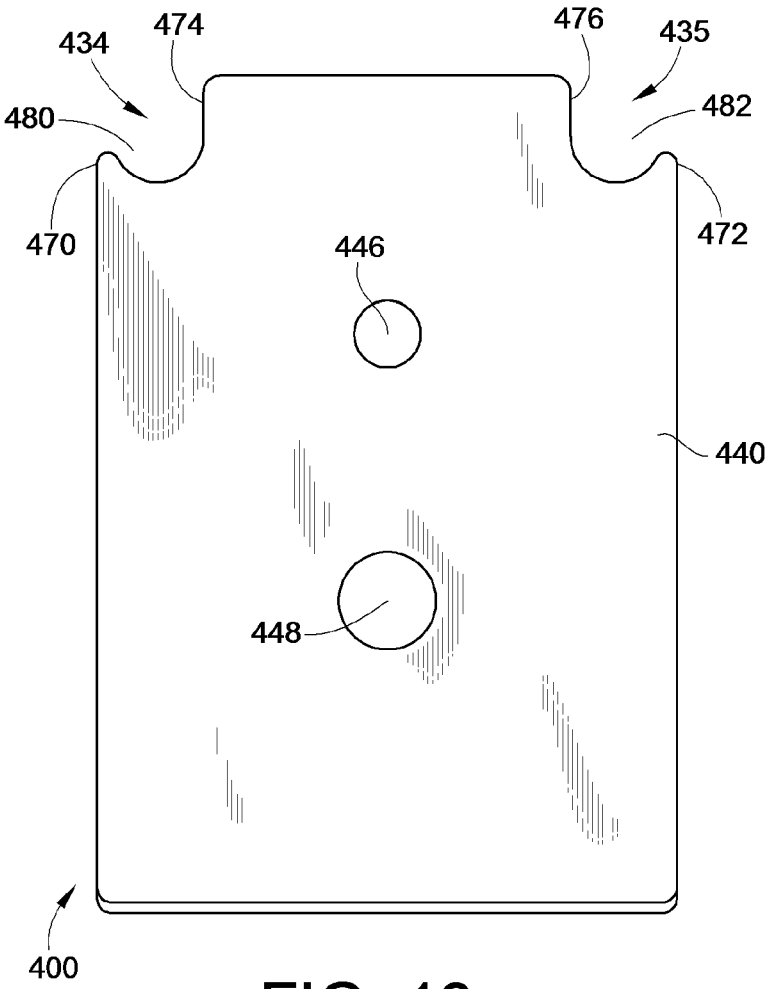
FIGS. 13 and 14 are rear profile and side profile illustrations of the end cap in FIGS. 10-12.
Figure 14:
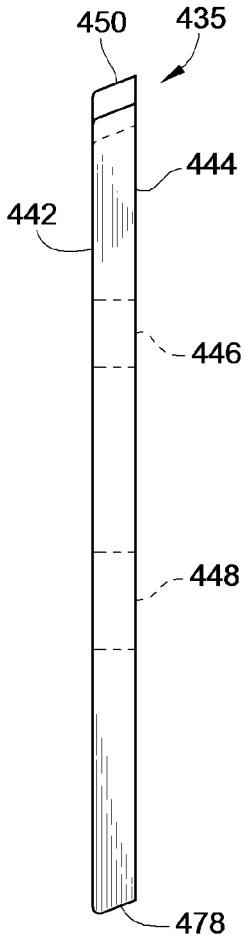

As illustrated in FIG. 11, the RTL 460, end cap 400 and rafter 110 are configured such that the end cap 400 is positioned adjacent the end of rafter 110 much like the previous embodiments, such that the surfaces extending between the outer and inner surfaces 442, 444 of the end cap form substantially continuous surfaces with the corresponding surfaces of the rafter 110.

The end cap 400 need not perfectly abut the end of rafter 110. Thus, a gap may be formed between the end cap 400 and the end of the rafter 110 and the end cap 400 will still be considered to be adjacent the end of the rafter 110.

In operation, the support troughs 434, 435 of the end cap 400 will vertically support the weight of the portion of the fabric panels 115 that has not yet been thread through C-channels 134, 135 of the rafter. Further, the C-channels 134, 135 of the rafter provide the majority of the lateral support for the fabric panels 115.

Further embodiments of the end cap 400 may also include tensioning devices attached to the outer surface 442 of the end cap 400, like the embodiment illustrated in FIG. 9.

Thus, one method of assembling a tent 100 according to the teachings of the present invention includes operably aligning an end cap with an end of a rafter 110. The method may also include mounting the end cap adjacent the end of the rafter 110 such that a pair of support troughs of the end cap substantially aligns with a corresponding pair of C-channels of the rafter 110. The method also includes feeding edges of fabric panels 115 forming the shell of the tent 100 through the C-channels of the rafter 110. The method also includes supporting the weight of the portion of the fabric panels 115 that has not yet been passed through the C-channels of the rafter 110 by the end-cap and particularly the support troughs thereof.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A tent comprising:

a frame including at least one structural member having a pair of first C-channels extending along a length of the structural member;

at least one fabric panel including an enlarged edge portion received in one of the first C-channels of the structural member;

an end cap positioned adjacent to an end of the structural member, the end cap having a main body having an outer face and an inner face, opposite the outer face, the inner face facing the end of the structural member;

a tensioning device coupled to the end cap engaging a free end portion of the fabric panel, the free end portion of the fabric panel extending substantially perpendicular to the edge portion, the tensioning device vertically adjustable to increasingly pull the fabric panel axially out of the first C-channel, not laterally through a mouth of the C-channel.

2. The tent of claim 1, wherein the tensioning device includes an internally threaded mount coupled to the main body and a cooperating externally threaded adjustment rod, the adjustment rod moveable relative to main body.

3. The tent of claim 2, wherein the tensioning device further includes at least one fabric panel attachment bar extending laterally outward from the adjustment rod and into a pocket formed by the free end portion the fabric panel, the at least one fabric panel attachment bar extending generally parallel to the free end portion.

4. A tent comprising:

a frame including at least one structural member having a pair of first C-channels extending along a length of the structural member;

an end cap positioned adjacent to an end of the structural member, the end cap having a main body having an outer face and an inner face, opposite the outer face, the inner face facing the end of the structural member, the main body including a pair of support troughs, one of the support troughs aligned with a corresponding one of the first C-channels and the other one of the support troughs aligned with a corresponding other one of the first C-channels;

at least one fabric panel including an enlarged edge portion received in one of the first C-channels of the structural member and the corresponding support trough of the end cap;

further including a tensioning device mounted to the main body and connected to an end portion of the fabric panel; and wherein the tensioning device includes an adjustment rod, the adjustment rod is moveable relative to the main body along an axis that extends at a non-zero angle relative to the length of the structural member.

5. The tent of claim 4, wherein the tensioning device includes an internally threaded mount and the adjustment rod is threaded, the adjustment rod moveable relative to the front face via rotational motion relative to the threaded mount.

6. The tent of claim 4, wherein the at least one fabric panel includes a free edge that extends generally perpendicular to the enlarged edge portion; and wherein the adjustment rod is moveable relative to the main body to adjust the tension of the at least one fabric panel only in a direction extending perpendicular to the free edge.

7. The tent of claim 4, wherein the adjustment rod is movable generally parallel to an outer face of the main body.

8. The tent of claim 4, wherein the tensioning device is entirely external to the structural member.

9. A tent comprising:

a frame including at least one structural member having a pair of first C-channels extending along a length of the structural member;

an end cap positioned adjacent to an end of the structural member, the end cap having a main body having an outer face and an inner face, opposite the outer face, the inner face facing the end of the structural member, the main body including a pair of support troughs, one of the support troughs aligned with a corresponding one of the first C-channels and the other one of the support troughs aligned with a corresponding other one of the first C-channels;

at least one fabric panel including an enlarged edge portion received in one of the first C-channels of the structural member and the corresponding support trough of the end cap; and further including a tensioning device mounted to the main body and connected to an end portion of the fabric panel; and wherein the tensioning device further includes an adjustment rod that is moveable relative to the main body, the tensioning device further includes at least one fabric panel attachment bar extending outward from the adjustment rod and the end portion of the fabric panel defines a pocket extending generally perpendicularly to the edge portion, the pocket extending parallel to a free edge of the fabric panel, the free edge extending perpendicular to the enlarged edge portion, the attachment bar extends into the pocket to connect the tension device to the fabric panel.

10. The tent of claim 9, wherein the attachment bar extends into the pocket generally parallel to the free edge of the fabric panel and perpendicular to the enlarged edge portion.

11. A tent comprising:

a frame includin at least one structural member having a pair of first C-channels extending along a length of the structural member;

an end cap positioned adjacent to an end of the structural member, the end cap having a main body having an outer face and an inner face, opposite the outer face, the inner face facing the end of the structural member, the main body including a pair of support troughs, one of the support troughs aligned with a corresponding one of the first C-channels and the other one of the support troughs aligned with a corresponding other one of the first C-channels;

at least one fabric panel including an enlarged edge portion received in one of the first C-channels of the structural member and the corresponding support trough of the end cap; and further including a tensioning device mounted to the main body and connected to an end portion of the fabric panel; and wherein the tensioning device includes an adjustment rod that is adjustable relative to the main body of the end cap, the tensioning device further includes a pair of lateral attachment bars that extend generally perpendicularly from the adjustment rod and are generally coaxial with one another.

* * * * *